US006089335A

United States Patent [19]

Able

[11] Patent Number: 6,089,335

[45] Date of Patent: Jul. 18, 2000

[54] POSITIVE LATCH CORE BARREL APPARATUS

[75] Inventor: Robert E. Able, Bozeman, Mont.

[73] Assignee: Boart Longyear International Holdings, Inc., Salt Lake City, Utah

[21] Appl. No.: 09/212,551

[22] Filed: Dec. 16, 1998

[51] Int. Cl.[7] ..... E21B 25/02; E21B 9/20

[52] U.S. Cl. ..... 175/246; 175/234

[58] Field of Search ..... 166/153, 156, 166/236, 239, 244, 246–250; 175/243, 246, 247, 234, 236, 317, 58, 324, 257, 403

[56] References Cited

U.S. PATENT DOCUMENTS

| | | |
|---|---|---|
| 473,908 | 5/1892 | Bullock . |
| 474,080 | 5/1892 | Bullock et al. . |
| 3,120,283 | 2/1964 | Braun . |
| 3,126,064 | 3/1964 | Miller . |
| 3,266,835 | 8/1966 | Hall et al. . |
| 3,340,939 | 9/1967 | Lindelof . |
| 3,874,466 | 4/1975 | Fulford . |
| 4,834,198 | 5/1989 | Thompson . |
| 5,020,612 | 6/1991 | Williams . |
| 5,325,930 | 7/1994 | Harrison . |
| 5,339,915 | 8/1994 | Laporte et al. . |

*Primary Examiner*—Robert E. Pezzuto
*Attorney, Agent, or Firm*—Clayton R. Johnson

[57] ABSTRACT

The drilling apparatus includes a wire line core barrel inner tube assembly movable to a drill string bit end to have its landing ring seat on the drill string landing shoulder and its latches latchingly retain the assembly adjacent the bit end. The assembly includes a fluid bypass channel in a latch body, fluid retention mechanism movable in the latch body to a fluid restriction position to maintain a head of fluid in the drill string even when drilling into a fractured earth formation and an axial outer-open position, a retractor for retaining the latches fully retracted as the assembly moves inward and after the latch body seats on the shoulder, retain the retention mechanism to provide a higher pressure signal than in the restriction position until both latches are in their latch seated position, and thence moves to retain them in their seated position until the retractor is moved outwardly and an overshot coupling device axially movable relative to the retractor and the latch body to through the retractor, move the retention mechanism toward its open position prior to retracting the latch body outwardly of the landing shoulder. The assembly also includes a hollow spindle bearing subassembly fluidly connecting a core receiving tube to the bypass channel to permit more rapid descent of the assembly in the drill string and a valve ball to prevent inward fluid flow through the subassembly.

20 Claims, 6 Drawing Sheets

POSITIVE LATCH CORE BARREL APPARATUS

BACKGROUND OF THE INVENTION

The present invention relates to drilling apparatus and more particularly to a fast descent core barrel head assembly with mechanism to maintain the latches in a retracted position until the head assembly seats on the drill sting landing shoulder.

In many prior art wire line core barrel assemblies, the latch mechanism is mounted to the latch body and is forced out and held in a locked (latch seated) position by gravity or spring mechanism. With latch mechanism constantly resiliently urged transversely outwardly, the rate of descent in the drill string is slowed as a result of the latches dragging against the inner peripheral wall of the drill string.

It is a common occurrence in certain rock formations that the bore hole is completely dry to the bottom. One reason, as drilling fluid is pumped into the drill string and passes through the drill string, no fluid is returned to the surface in the annular space between the outer peripheral surface of the drill string and the surface of the bore hole as a result of fractured or porous rock formation wherein all the drilling fluid is absorbed or leaks into the formation rather than being pumped back to the surface. This problem is aggravated by increasing hole depths where the hydrostatic head pressure of the fluid column inside the drill string is greater than the pressure needed to flow fluid across the face of the drill bit. The result of this pressure difference is the condition in which, due to the fluid column head pressure, fluid is flowing through the drill bit at a faster rate than is being supplied into the drill string by the fluid pumped, a column of air develops inside the drill string. Due to the compressibility of air, the fluid flow across the bit face can stop under certain conditions and no significant increase in fluid gage pressure is denoted on the surface until after failure of the drill bit due to a lack of fluid flow across the bit face.

U.S. Pat. No. 3,120,283 to Braun discloses a core barrel inner tube assembly having an overshot coupling portion retained in a position by the latches in their retracted position to prevent fluid bypass until the latches move to their latch seated position and thence under gravity, or inward fluid pressure, move to permit fluid bypass and prevent the latches moving to their retracted position until the coupling portion is retracted.

U.S. Pat. No. 3,266,835 to Hall discloses a core barrel inner tube assembly fluidly propellable in any direction and includes a valve assembly connected to a spearhead and resiliently urged to a position to block fluid flow. When the inner tube assembly moves to its inner position, water pressure forces the spearhead assembly to move to open a bypass channel and allow the latches to move to a latch seated position. If the latches do not seat properly, a valve does not open and bypass is blocked.

U.S. Pat. No. 5,339,915 to Laporte et al discloses a one way retention valve in a core barrel inner tube assembly that functions to retain drilling liquid pressure in lost circulation situations resulting from, for example drilling into a cavity or into a broken earth formation. However, with such apparatus, the descent in a drill sting is very slow since the fluid bypass channel is blocked and liquid can not bypass except around the exterior of the latch body landing shoulder. Further, a heavy duty spring is used to create a high liquid pressure and retain a column of liquid above the core barrel inner tube assembly. This high pressure in combination with pump surging has resulted in wear on the valve ball seat. The ball essentially hammers the seat which, over a period of time, damages the seat.

U.S. Pat. No. 5,020,612 to Williams discloses a core barrel inner tube assembly having a resilient ring (bushing) in the fluid bypass channel through which a valve ball is forced by fluid under pressure when the inner tube assembly is in its core collecting position at the bit end of the drill string.

In order to make improvements in core barrel inner tube apparatus to enhance its rate of descent while maintaining a minimum head of fluid in the drill string during the drilling operation together with requiring the latches to be properly seated for the fluid retention system to function properly, and having a way of releasing the head of drilling fluid at the end of the drilling cycle prior to retraction of the apparatus off the drill string landing shoulder, this invention has been made.

SUMMARY OF THE INVENTION

A drilling assembly that is movable in a drill string to the inner end portion thereof for being latchingly retained therein includes a drilling head assembly with a latch body having an overshot coupling device and a latch retractor mounted thereto for limited axial movement relative to the latch body and relative to each other, to, as the coupling device moved outwardly, first moves the retractor from a position retaining the latches in a latch seated position and through the retractor, retract the valve mechanism from a position restricting fluid flow through a latch body bypass channel to a position to permit increased fluid flow through the channel to thereby decrease the force required to retract the inner tube assembly and then retract the latches prior to applying a withdrawing force to the latch body. As the assembly moves inwardly in the drill string, the overshot coupling device and retractor with the valve mechanism mounted thereto are free to float outwardly or retained relative to the latch body to retain the bypass channel open and positively retain the latches out of engagement with the drill string which, in conjunction with a hollow spindle bearing subassembly opening to the latch body bypass channel, permit a more rapid descent of the assembly in the drill string. When the inner tube assembly seats on the drill string landing shoulder, the retractor moves inwardly relative to the latch body from a position retaining the latches in a fully retracted position to a position moving and retaining the latches in a latch seated position while the valve mechanism moves from a fluid bypass open position to a position to restrict inward flow through the bypass channel. Just before both latches move to a properly seated position, a high pressure signal is obtained and then a normal pressure signal is obtained when both the latches are in their latch seated position. A spring is provided to act between the retractor and the valve device to build up and maintain a back pressure in the drill string which is greater than or equal to the fluid column hydrostatic head pressure in order to prevent the formation of a column of air in the drill string while drilling. A drilling tool is attached to the drilling head assembly latch body by the hollow spindle and bearing subassembly to extend inwardly thereof, the tool being, for example, a core barrel inner tube and etc.

One of the objects of this invention is to provide new and novel means in a core barrel inner tube assembly that will permit increased rate of descent, in part by positively retaining the latches in a fully retracted position, and will result in a high pressure signal being obtained at the drilling surface when said assembly has landed on the drill string landing shoulder and then a lower normal pressure signal only if both latches properly latchingly move into the drill string latch seat. Another object of this invention is to provide new and novel means mounting valving mechanism to extend within the latch body fluid bypass channel for building and maintaining a back pressure in the drill string that is greater than or equal to the fluid column hydrostatic head pressure to prevent the formation of a column of air in the drill string while drilling and to control the rate of fluid flow through a drilling head assembly bypass channel. In furtherance of the last mentioned object, it is a further object of this invention to provide new and novel means for mounting the valving device and permitting easily adjusting the inward pressure required to permit greater fluid flow through the bypass channel at a given pump-in pressure.

A different object of this invention is to provide new and novel means for retaining the latches in a latch retracted position as an inner tube head assembly moves axially inwardly in a drill string and once the latches are in a latch seated position, retain the latches in the seated position. In furtherance of the last mentioned object, it is another object of this invention to provide a new and novel latch retractor for mounting and retracting valve mechanism controlling fluid flow in a latch body bypass channel.

For purposes of facilitating the description of the invention, the term "inner" refers to that portion of the drill string, or of the assembly, or an element of the assembly being described which, in its position "for use" in, or on, the drill string is located closer to the drill bit on the drill string (or bottom of the hole being drilled) than any other portion of the apparatus being described, except where the term clearly refers to a transverse circumference, direction, or diameter of the drill string or other apparatus being described. The term "outer" refers to that portion of the drill string, or of the assembly, or an element of the assembly being described which in its position "for use" in, or on, the drill string is located axially more remote from the drill bit on the drill string (or bottom of hole being drilled) than any other portion of the apparatus being described, except where the term clearly refers to a transverse circumference, direction, or diameter of the drill sting or other apparatus being described.

Figure 1A:
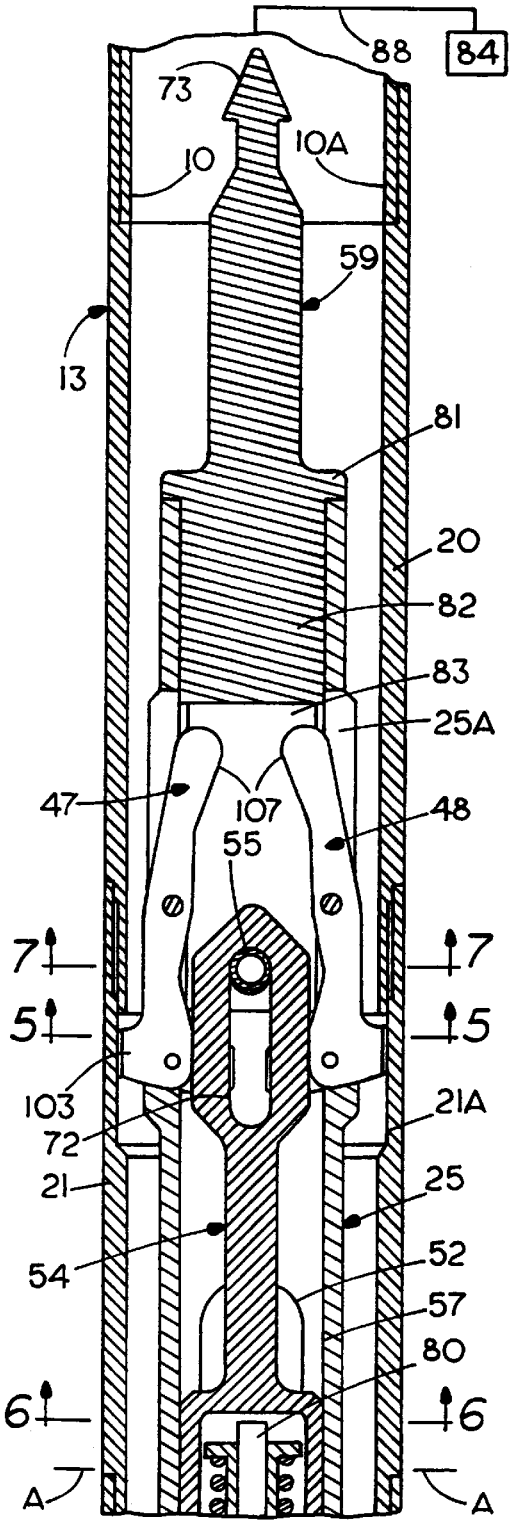
FIGS. 1A–1C when arranged above the other with their axial center lines aligned and lines A—A of FIGS. 1A and 1B aligned and lines B—B of FIGS. 1B and 1C aligned, form a composite longitudinal section through the drilling apparatus of the invention at the bit end of a drill string in a bore hole in a latch seated position with no fluid being pumped in under pressure into the drill string, intermediate portions of FIG. 1C being broken away and portions of the drill string axially inwardly of the latch body not being shown.
Figure 1B:
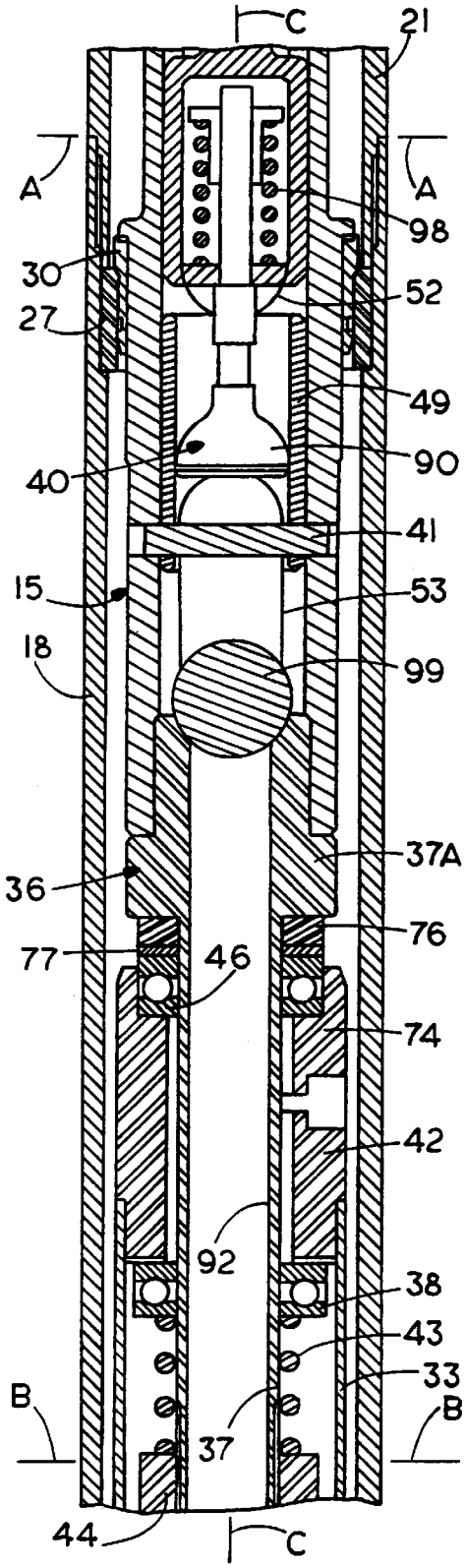
Figure 1C:
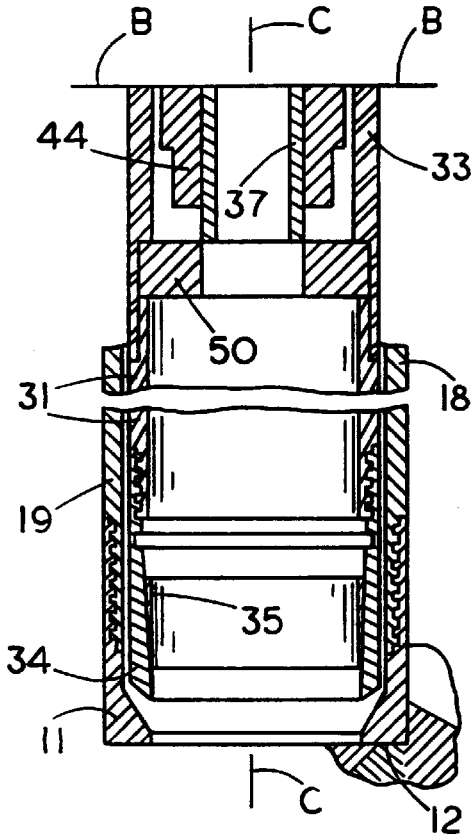

Referring now in particular to FIGS. 1A–1C, there is illustrated a hollow drill string 10 which is made up of a series of interconnected hollow drill rods (tubes). The drill string 10 is in a downwardly extending bore hole 12 drilled in rock or other types of earth formations by means of an annular core bit 11. The pump apparatus, which is indicated by bock 84, pumps fluid under pressure though line 88 into the outer end of the drill string 10 in a conventional manner, the illustrated part of the drill string 10 in FIGS. 1A–1C extending upstream (outwardly) of the bit in the bore hole 12 and may be at a considerable depth below the surface. The portion of the drill string attached to or extended below the pipe (rod) section 10A is commonly referred to as a core barrel outer tube assembly, generally designated 13, the core barrel outer tube assembly being provided for receiving and retaining the wire line core barrel inner tube assembly, generally designated 15, adjacent to the bit end of the drill sting. Details of the construction of the core barrel outer tube assembly used in this invention may be of the general nature such as that disclosed in U.S. Pat. Nos. 3,20,282 and 3,120,283. The outer tube assembly is composed of an adaptor coupling 21 that is threadedly connected to the core barrel outer tube 18 to provide a recess in which a landing ring (drill string landing shoulder) 27 is mounted, a reaming shell 19 connected to the inner (lower) end of tube 18 and an annular drill bit 11 at the inner end of the reaming shell for drilling into the earth formation from which the core sample is taken. The outer end of the assembly 13 includes a locking coupling 20 that connects the adaptor coupling to the adjacent pipe section 10A of the drill string. At the opposite end of the coupling 20 from the pipe section 10A, the locking coupling, in conjunction with the annular recess of the coupling 21, forms a latch seat 21A inside of the surface of the adaptor coupling against which the latches, generally designated 47, 48 of the latch assembly L are seatable for removably retaining the core barrel inner tube assembly 15 adjacent to the core bit. The inner end portion of the locking coupling may have a conventional projection flange (not shown) which extends as a partial cylindrical surface more closely adjacent to the core bit than to the main part of said coupling to bear against a latch to cause the latches and other portions of the inner tube assembly to rotate with the drill string when the latches are in a latch seated position.

The core barrel inner tube assembly 15 includes a head assembly H having a latch body, generally designated 25. The latch body has an axial intermediate enlarged diametric flange 39 with a landing ring 30 mounted thereon in abutting relationship to the flange or else has a conventional integrally formed annular, inwardly facing shoulder. The latch body ring provides a latch body shoulder that is seatable on the drill string shoulder which is provided by the landing ring 27. The latch body is tubular throughout its axial length (axial bore 57 extending axially therethrough), an intermediate portion thereof providing a fluid bypass channel F having diametric opposite inlet ports 52 opening to an axial bore 57 and to the clearance space between the latch body and the drill string outwardly of the shoulder 30, and diametric opposite outlet ports 53 that open to the bore 57 axially inwardly of the outer end portion of a bushing 49 and to the clearance space between the latch body and the drill string inwardly of the shoulder 39. Each of the ports 52, 53 is axially elongated, for example, of axial lengths greater than twice the inner diameter of the latch body bore 57. Advantageously, the ports 52 are of axial lengths about one-half again that of ports 53.

The bushing 49, which in part defines part of the bypass channel F, is removably mounted in the bore 57 to form a close fit with the latch body, a transverse pin 41 extending through the inner end portion of the bushing and extended into the latch body to removably mount the bushing to the latch body. The outer end of the bushing is closely axially adjacent to the inner end of ports 52. The inner end portion of the bushing has inwardly opening cutouts 45 that advantageously are about the same size and shape as the radially adjacent parts of the outer end portions of the ports 53. The axially major portion of the cutouts is located axially outwardly of the pin 41.

The bushing 49 constitutes part of a liquid retention valve mechanism, generally designated 40, for controlling fluid flow through the lath body bypass channel. The fluid bypass channel F permits fluid flow to bypass the landing ring 27 and the latch body ring 30 when the ring 30 is seated on the ring 27. That is, the portions of the inner tube assembly from the latch body ring 30 and axially inwardly and outwardly of ring 30 are of smaller maximum diameters than the maximum outer diameter of ring 30. The latch body landing ring, when seated on the drill string landing ring, blocks or severely restricts axial inward flow radially therebetween.

The assembly 15 also includes a core receiving tube 31, an inner tube cap 33 threaded to the outer end of the core receiving (collecting) tube, and a spindle and bearing subassembly, generally designated 36, for connecting the cap to the inner portion of the latch body. The core receiving tube has a replaceable core lifter case 34 and a core lifter 35, the structure and function of which may be generally the same as set forth in U.S. Pat. No. 2,829,868.

The spindle and bearing subassembly includes an axially elongated, hollow (tubular) spindle member (bolt) 37 having its outer end threadedly connected to the latch body inner end portion to open to the bypass channel F inwardly adjacent to the opening of outlet ports 53 to bore 57 with the latch body abutting against the spindle member enlarged diametric portion 37A. A hanger bearing 38 is axially slidably mounted on the spindle member 37 in abutting engagement with the inner end of the bearing housing (bearing spindle) 42 which is also slidably mounted on the spindle member and threadedly connected to the cap 33. A coil spring 43 on the spindle member has its opposite ends respectively abutting against the hanger bearing and a lock nut 44 threaded on the spindle member. The coil spring constantly resiliently urges the bearing housing toward the spindle enlarged portion 37A. The bearing housing mounts a thrust bearing assembly 46 in abutting relationship with a metal washer 77, there being conventional resilient shut of valve mechanism 76 on the spindle bolt between metal washer 77 and the spindle member enlarged diametric portion 37A.

A seal retainer 50 is mounted in an annular groove cooperatively formed by the inner tube cap 33 and the core receiving tube 31 to be in fixed axial relationship thereto and form a fluid seal between the cap and receiving tube and the radial outer peripheral surface of the inner end of the spindle member 37. The seal retainer is axially movable relative to the spindle member a limited amount with the inner end of the spindle member opening to the core receiving tube while preventing fluid flow from the core receiving tube to the annular clearance space between the spindle member and to the inner tube cap.

An overshot coupling device, generally designated 59, has a spearhead 73, an axial intermediate enlarged diametric flange 81 abuttable against the axial outer transverse terminal edge of the latch body to limit the axial inward movement of the device relative to the latch body and an elongated cylindrical portion 82 axially slidably extended into the outer end portion of the latch body. The axially inner part of the cylindrical portion has an axially elongated retractor slot 83 that opens through its inner end to have parts of the latches pivotally extended thereinto.

Figure 3A:
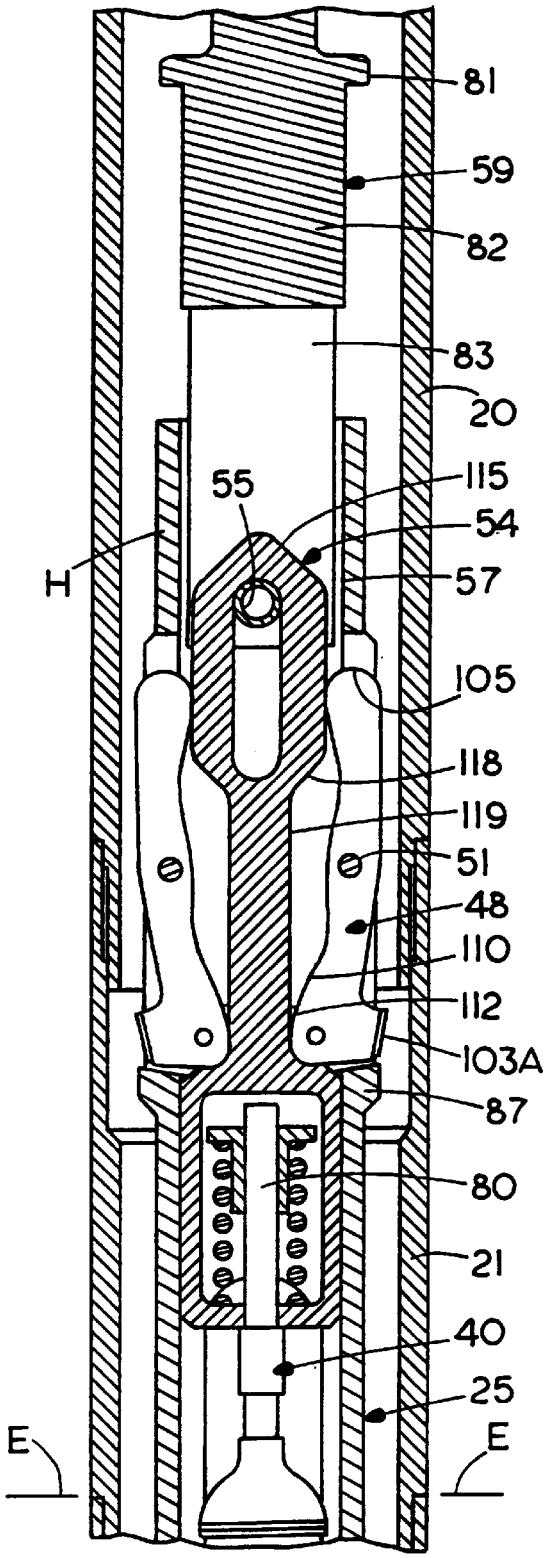
FIGS. 3A and 3B, one arranged above the other with their axial center lines aligned and lines E—E aligned, form a composite fragmentary longitudinal section through the core barrel apparatus as it is being retracted.

A latch retractor, generally designated 54, is axially slidably extended in the latch body bore and in the retractor slot, the latch retractor being mounted for limited axial movement relative to the latch body for retracting the latch assembly from its latch seated position to its latch release position in a manner set forth below and alternately, forcing the latch assembly to move to its latch seated position when the latches are adjacent to the latch seat. A transverse pin 55 is fixedly mounted to the inner end portion of the overshot coupling device 59, and is extended through an axially elongated slot 72 in the outer end portion of the latch retractor 54 whereby the latch retractor can move axially a limited amount within the coupling device retractor slot and is extended into the diametric opposite, elongated slots 58 in the lath body. The slots 58 are of a length that the pin 55 abuts against the inner ends thereof in the position shown in FIG. 1A to permit the desired fluid flow through the bypass channel during normal drilling operations while maintaining the desired fluid head in the drill string and abuts against the outer end in the position shown in FIG. 3A wherein the bypass channel is in its open position. Thus, the coupling device may be moved axially a limited amount relative to the latch retractor and latch body.

The core barrel inner tube assembly also includes the latch assembly L having latches, respectively generally designated 47 and 48, with their axial intermediate portions pivotally mounted in latch body slots 25A by diametric opposite, parallel transverse pivots 51 which are mounted to the latch body in fixed axial relationship to the latch body. The latches are of the same size and shape, but are mounted in oppositely faced relationship.

Figure 4A:
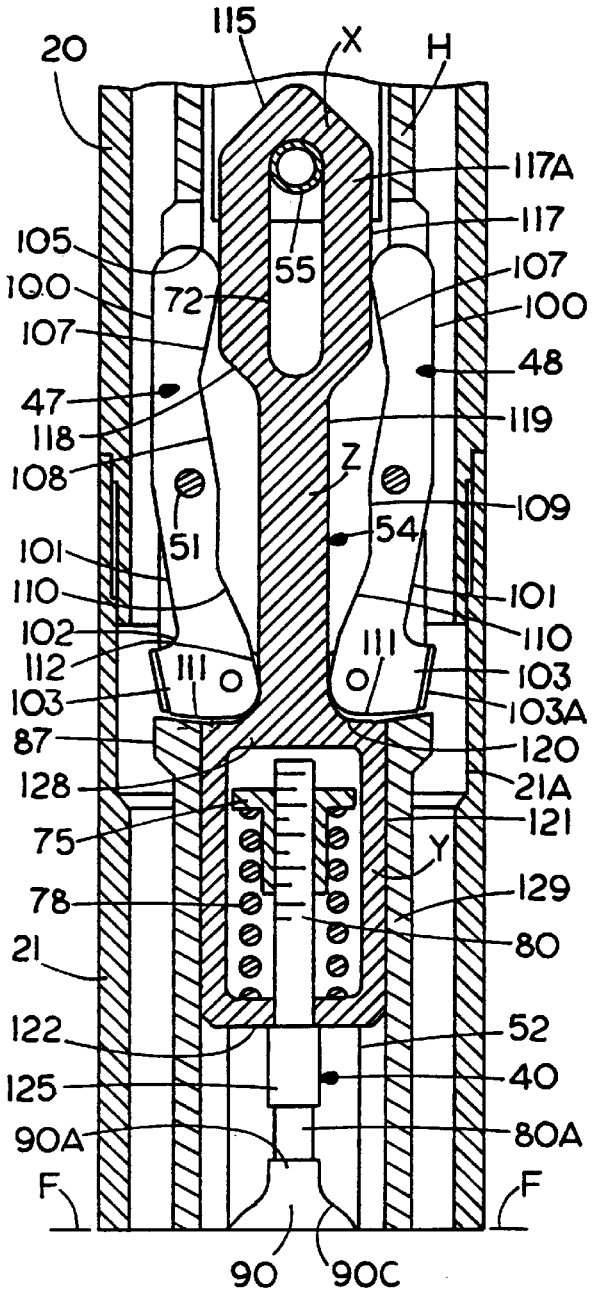
FIGS. 4A and 4B, one arranged above the other with the axial center lines aligned and lines F—F aligned, form an enlarged composite fragmentary longitudinal section of a portion of the structure shown in FIGS. 3A and 3B; and are generally taken along the line and in the direction of the arrow 5—5 of FIG. 1A.
Figure 4B:
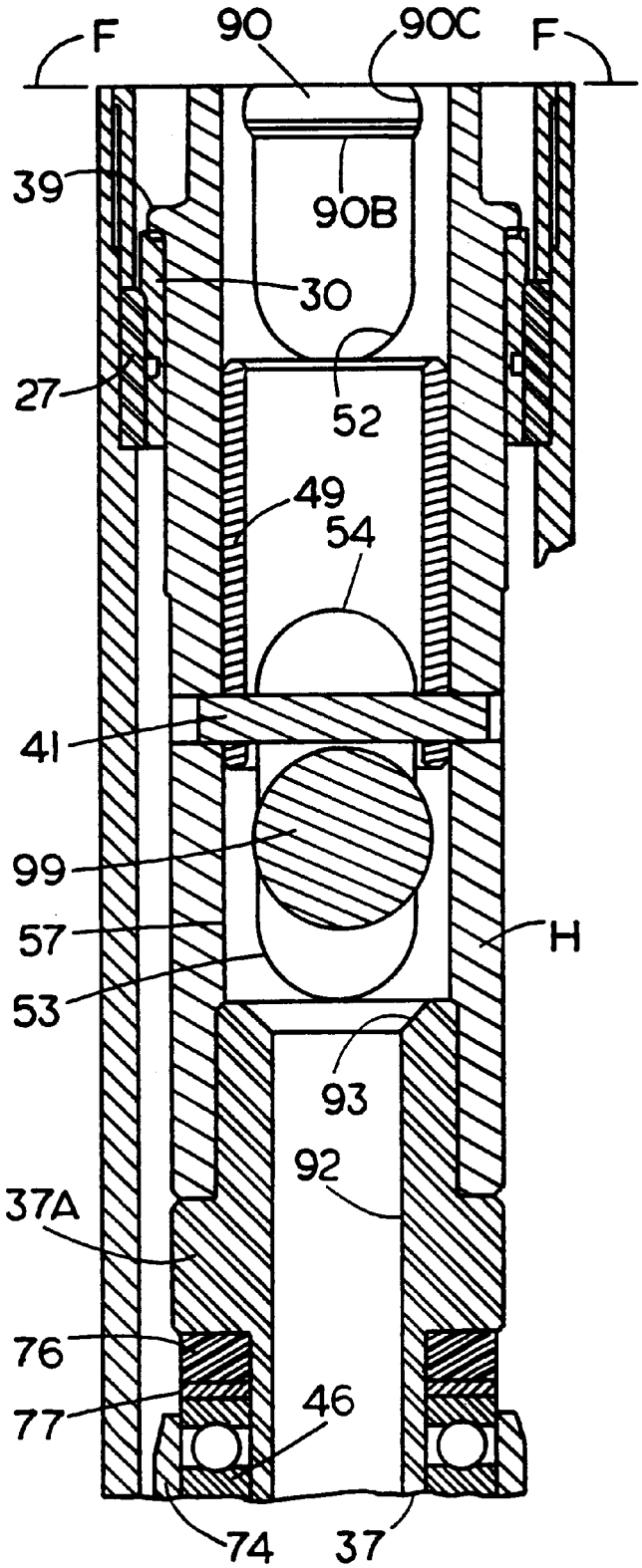
Figure 5:
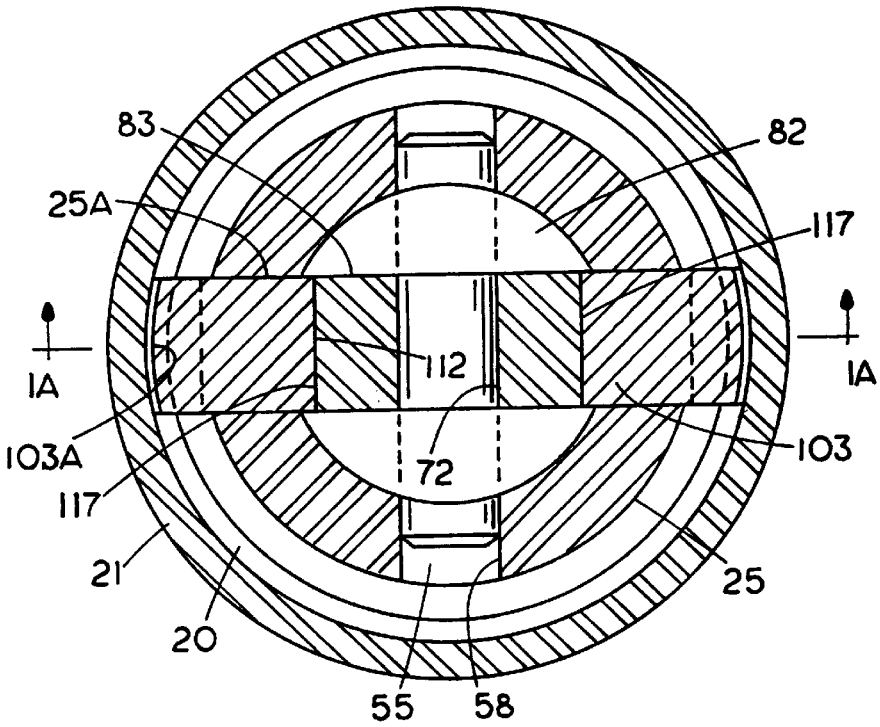
FIG. 5 is a transverse cross sectional view that is generally taken along the line and in the directions of the arrows 5—5 of FIG. 1A.
Figure 6:
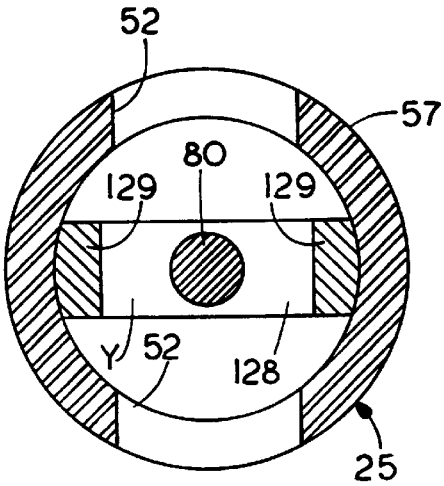
FIG. 6 is a transverse cross sectional view that is generally taken along the line and in the directions of the arrows 6—6 of FIG. 1A.
Figure 7:
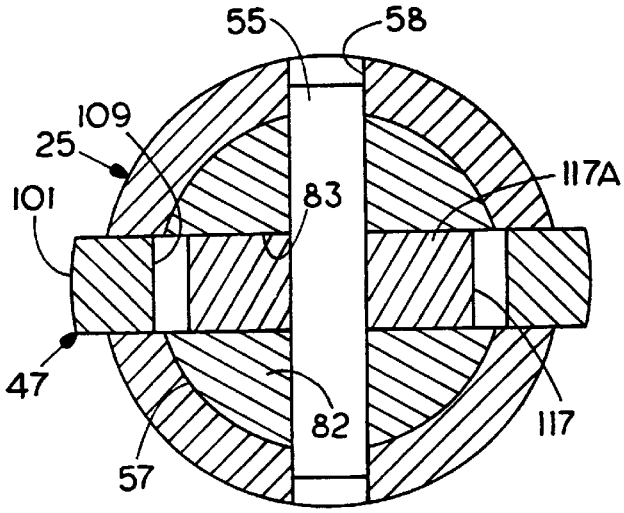
FIG. 7 is a transverse cross sectional view that is generally taken along the line and in the direction of the arrows 7—7 of FIG. 1A.

For purposes of facilitating the description of the latch assembly L and the latch retractor 54, it will be assumed the inner tube assembly is in the position shown in FIGS. 4A and 4B, or is moving axially inwardly in the drill string to such a position. The latches have axially outer, radially outer edge portions 100 that in the plane of the central axis C—C of the latch body are parallel or nearly parallel to one another and to the central axis, axially intermediate, transverse outer edge portions 101 that intersect with outer edge portions 100 transversely outwardly and axially adjacent to the respective pivot 51 and arcuately curved edge portions 102 extending inwardly and transversely outwardly relative to one another to intersect with the predominately axially extending, radially outer edge portions 103A of the latch tabs 103 which extend transversely more remote from one another than the axially adjacent parts of the latches having surface portions 101. The latches also have axially outer, predominately axially extending, radially inner linear edge portions 107, 108 that intersect with edge portions 107 diverging axially inwardly, and inwardly and edge portions 108 converging in an axial inward direction. Further, the latches have axially inner, predominately axially extending, radially inner linear edge portions 109, 110 that intersect with edge portions 109 being parallel and intersecting with edge portions 108 and edge portions 110 converging in an axial inward direction. The latches additionally have predominately axially extending, axially inwardly converging linear edge portions 112 joining edge portions 110 to arcuately curved edge portions 111 which in turn intersect with edge portions 103A. The angle of convergence of edge portions 112 is at a smaller angle than that of edge portions 110. Edge portions 111 extend axially inwardly and thence predominately transversely outwardly of one another.

Advantageously, the axially extending linear dimensions of the combination of surface portions 107, 108 of one of the latches is less than that of the axial linear dimension of surface portion 117, but greater than that of surface portions 110, 112 of the same latch. Further, with the latches in their retracted position, the diametric spacing of intersections of surfaces 105, 107 of the latches is greater than the corresponding spacing of the intersection of surfaces 111, 112. However, with the latches in their latch seated position, the diametric spacing of intersections of surfaces 105, 107 of the latches is less than the corresponding spacing of the intersections of surfaces 111, 112

The latch retractor 54 has an axial outer cam portion X, an axial inner valve assembly cage mount Y and an axially elongated stem Z that along its length is of a substantially smaller transverse dimension than each of the mount Y and the cam portions as viewed in FIG. 4A. As viewed in the plane of the inner tube assembly central axis C—C that is perpendicular to the central axes of the pin 55 and the pivot axes of pivots 51, the cam portion X adjacent to its axial outer end, has axially inwardly diverging edge portions 115 which are joined to the axial outer ends of the axially inwardly extending parallel linear edge portions 117 of axially elongated legs 117A that are equally radially spaced from the central axis C—C on diametrically opposite sides of the central axis and parallel thereto. The inner ends of edge portions 117 are joined to the axially inwardly converging edge portions 118 which in turn are joined to the outer ends of the parallel, axially extending edge portion of the stem Z. The outer end portion of the valve assembly mount Y has predominantly transversely extending, arcuately curved edge portions 120 that join the stem edge portions 119 to the parallel, axial outer edge portions 121 of the axially extending legs 129 of mount Y.

The cage mount Y has a transverse, axial outer end member 128, an axial inner transverse end member 122 and legs 129 joined to the radial outer ends of members 122, 128. Advantageously, the circumferential spacing of the legs is about the same as the corresponding dimension of the axial edge portions of the latch body that in part define ports 53, other than at their axial opposite ends while the transverse outer, axial surfaces of the legs form a close sliding fit with the latch body inner peripheral wall which defines bore 57.

The valving mechanism 40 includes the cylindrical tubular bushing 49 and an axially elongated rod (valve stem) 80 axially slidably extended through the inner transverse member 122 of the cage mount. The valve stem 80 extends through a coil spring 78, one end of which abuts against an outer stop 75 adjustably threaded on the outer end of the valve stem and at the opposite end abuts against the transverse end member 122 to resiliently urge the valve stem outwardly. The axial inward movement of the valve stem is limited by the compressibility (spring characteristics) of the spring 78 while the outward movement is limited by a transversely enlarged inner stop portion (stop) 125 of the valve stem to abut against the inner surface of the transverse member 122. When the retractor is in an axial position relative to the latch body such as shown in FIG. 4A, the valve stem portion 80A is radially opposite the ports 53 whereby it can be reached for being adjustably rotated to change the preloading of spring 78 without requiring disassembling the head assembly H of the inner tube assembly 15 as more fully set forth hereinafter.

The inner end of the valve stem extends within the fluid bypass channel and mounts a fluid retention valve member 90 having a maximum transverse diametric section that, advantageously, is of only a very slightly smaller diameter, for example a few thousands of an inch, than the minimum inner diameter of the bushing 49. Advantageously, the valve member 90 has a flat annular, axial inner transverse surface 90B and an axially extending, outer peripheral surface 90C that in longitudinal cross section is of progressively increasing diameters in an axial inward direction and then is of progressively decreasing diameters to act in cooperation with the transverse inner surface of the bushing to facilitate the valve member moving axially relative to the bushing minimum diameter portion to provide better control of the rate of fluid flow through the bushing during a drilling operation. The maximum transverse diameter of the valve member is axially much more closely adjacent to the axial inner surface 90B than its axial outer transverse surface 90A.

Mounted in the bore 57 is a valve ball 99 that is axially movable in the bore to an axially outer position that is axially outwardly of at least part of the openings of ports 53 to the bore 57. The diameter of the valve ball is greater than the inner diameter of each of the bushing and the minimum diameter bore portion 92 of the outer end portion of the spindle member 37. The axial inward movement of the ball is limited by seating on the valve seat formed by the minimum inner diameter portion 92 and the outer frustoconical surface 93 of the spindle member to either block or substantially block axial inward fluid flow from the bypass channel and thence inwardly through the spindle member. The axial outward movement of the valve ball is limited by abutting against the transverse pin 41 with the ports 53 extending inwardly and outwardly of the ball. Desirably, the total axial cross sectional area of the ports 53 is greater than the transverse cross sectional area of spindle bore 92 to minimize the restriction of fluid flow from the spindle member bore to and radially outwardly through the ports 53 as the assembly 15 moves axially inwardly in the drill string. With reference thereto, the diameter of the portion of bore 57 to which the ports 53 open is substantially greater than the diameter of each of the valve ball and spindle bore 92.

The maximum inward movement of the valve member 90 relative to the latch body and the bushing 49 is limited by the coupling member flange 81 abutting against the outer end of the latch body, the pin 55 abutting against the out end of slot 72 and the inner ends of slots 58 and the resiliency of the coil spring 78 which constantly resiliently urges the stop 75 outwardly. During the drilling operation, with fluid under pressure being pumped into the drill string and the structure as shown in FIGS. 1A and 1B, the maximum transverse diameter section of the valve member 49 is radially aligned with the bushing inner peripheral surface axially adjacent to the outer ends of ports 53 to maintain the desired head of fluid in the drill string while permitting limited fluid flow passing between the bushing and the valve member. The limited flow is sufficient to prevent burning of the drill bit. Depending upon the resiliency of the valve spring 78, and the increase of pump-in fluid pressure, the maximum diameter section is moved inwardly of the outermost portion of the ports 53 to permit increased fluid bypass flowing through the bypass channel F.

In using the apparatus of this invention, for example, the wire line core barrel inner tube assembly 15 is inserted into the outer end of the drill sting and, as the assembly moves inwardly (axially downwardly), by being lowered by a wire line overshot assembly (not shown), or is free falling through the drill string, the weight of the members extending inwardly of the coupling device and/or the resistance to inward movement results in the overshot coupling device moving to its axial outer position relative to the latch body whereby the retractor slot 83 is in part axially outwardly of the latch body. At this time, the pin 55 abuts against the outer end of the slot 72 whereby the latch retractor can not move inwardly relative to the overshot coupling device while the movement of the retractor outwardly is limited by the cage mount being abuttable against the inner ends of the latches. Due to the transverse maximum dimension of the retractor in the direction parallel to the axes latch pivots 51 being substantially less than the minimum inner diameter of the latch body bore 57 and in the transverse direction perpendicular thereto being even less, during the descent of the inner tube assembly in the drill string, there is a fluid flow path through the bore 37, ports 52, 53 and bore 57 transverse outwardly through latch body slots 25A for fluid to act against the inner transverse surface of the overshot coupling device.

During the inward movement, the latches are retained in their retracted position by the outer curved portions 105 that join surface portions 107 and 100 of the latches abutting against the cam portion edges portions 117, the diametric spacing of the surface portions 117 being such to maintain the latches our of contact with the drill string. At this time, the latch transverse inner surfaces 111 are abuttable against the cage mount surfaces 120 to limit the outward movement of the retractor relative to the latch body. The retractor in its outermost position with the pin 55 abutting against the outer end of slot 72 and/or the outer ends of latch body slots 58 limits the outward movement of the overshot coupling device relative to the latch body.

With the retractor and coupling device 59 in their outermost position relative to the latch body, the entire valve member is located axially intermediate the axial opposite ends of the inlet ports 52, the maximum diameter section of the valve member is substantially less than the radial adjacent part of latch body peripheral wall defining bore 57 and the valve ball 99 is abuttable against pin 41 to be located outwardly of the valve seat 93 whereby fluid can flow through the core barrel receiving tube, thence through the spindle bore and transversely outwardly through ports 52 and 53 and further outwardly through the bore 57. Such fluid flow, together with the latches being maintained out of abutting relationship with the inner peripheral wall of the drill string, resistance to inward movement of the inner tube assembly is decreased. With reference thereto, the diametric spacing of the cam surfaces 117 prevents the latches pivoting to have their transverse outermost edge surfaces 103A extending significantly transversely more remote from the inner tube assembly and drill string central axes C—C than the outer peripheral surface of the axially adjacent, enlarged diametric flange 87 of the latch body.

As the inner tube assembly landing ring seats on the drill string landing ring, the coupling device moves relative to the latch body to have its flange 81 abut against the outer transverse edge of the latch body, and pin 55 moves inwardly in the slot 72 due to the weight of the overshot coupling device 59 and/or together with inward fluid pressure acting on them. Further, the latch tabs 103 are radially opposite the latch seat 21A, the overshot coupling device and the retractor member 54 move axially inwardly relative to the latch body from the FIG. 3A position to the FIG. 2A position and the valve ball 99 moves to seat on the valve seat, if outwardly thereof.

With the coupling device moving inwardly, the retractor is free to and does move inwardly relative to the latch body which permits the valve member 90 moving toward and into the bushing, and fluid in the drill string and the cam portion X abutting against the transverse inner surfaces of the latches usually results in the retractor moving inwardly more slowly than the coupling device. As the coupling device moves inwardly relative to the retractor, and the retractor moves inwardly relative to the latch body, the intersecting parts of cam surface portions 117, 118 move inwardly of the outer ends of latch surface portions 109 to have the cam portion parallel surfaces being transversely therebetween while surface portion 110 and mount surfaces 120 are a substantial distance inwardly of the latch inner end portions. However, at this time the latches can not pivot to their latch seated position due to the cam surfaces 117 being between the outer end portions of latch surfaces 107.

As the intersecting parts of cam surfaces 117, 118 move inwardly of the intersection of latch surfaces 109, 110, due to the transverse spacing of the intersection of surfaces 107, 108 being greater than the diametric spacing of cam surfaces 117 and surfaces 110 then converging inwardly, the cam portion forces the latches 47, 48 to pivot in the direction of the arrows 123, 124 respectively to move toward their latch seated positions. As a result, the tabs of the latches move continuously transversely away from one another to their latch seated position until the intersections of cam surfaces 117, 118 move inwardly of the intersection of the latch surfaces 110, 112. With the latches in their seated position, the surfaces 112 are parallel to one another with cam surfaces 117 being therebetween to prevent the latches moving out of their seated position until cam surfaces 117 are moved outwardly of latch surfaces 112.

Figure 3B:
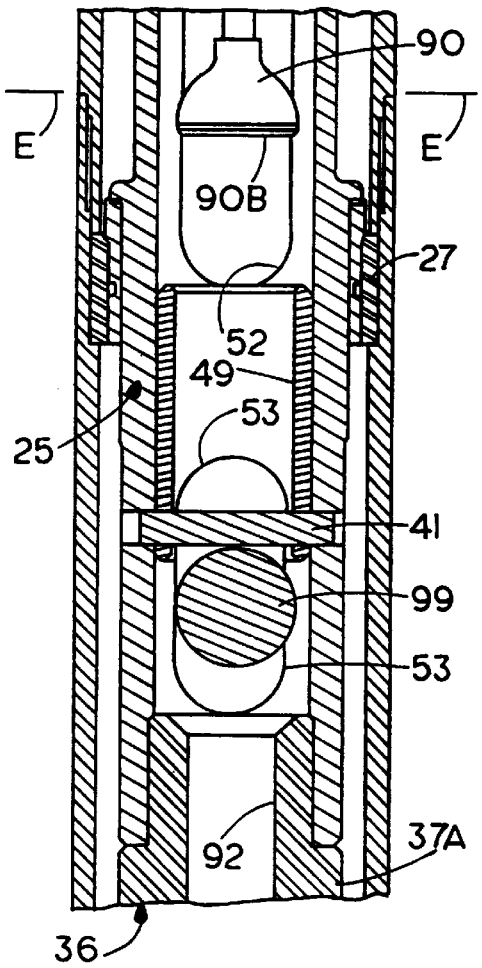

With the inner tube assembly landing ring seating on the drill string landing ring to block axial inward fluid flow radially therebetween, the retractor and the valve mechanism move from a position wherein the maximum diameter section of the valve member is axially about midway between the outer and inner edges of the ports 52 (see FIG. 3B) whereby fluid can flow inwardly through the annular clearance space between the valve member and inner peripheral wall of the latch body bore and transversely inwardly through the inner portions of the ports 52 to pass through the bushing to a position wherein the valve member enters into the outer end of the bushing to provide a high pressure signal at the drilling surface. If both of the latches properly move into the latch seat, the valve member maximum diametric section can move inwardly of the axial outer edges of the opening of ports 53 and bushing cutouts 54 to permit fluid to pass inwardly through the latch body bore 57 and radially outwardly through ports 53 whereby the pressure at the surface drops to a normal pressure value to indicate the core barrel inner tube assembly is properly seated for taking core. The degree of extent of the valve member into the bushing 49 relative to the outer edge portion of ports 53 and cutouts 54 depends upon the characteristics of the spring 98, the tolerances and/or radial spacing of the inner peripheral wall of the bushing 49 and the valve member and the pressure at which fluid is being pumped into the drill string. At this time, the pin 55 is located in the outer end of the retractor slot 72 and the valve ball 99 is seated on the valve seat 93 to block axial inward flow into the core receiving tube.

Figure 2A:
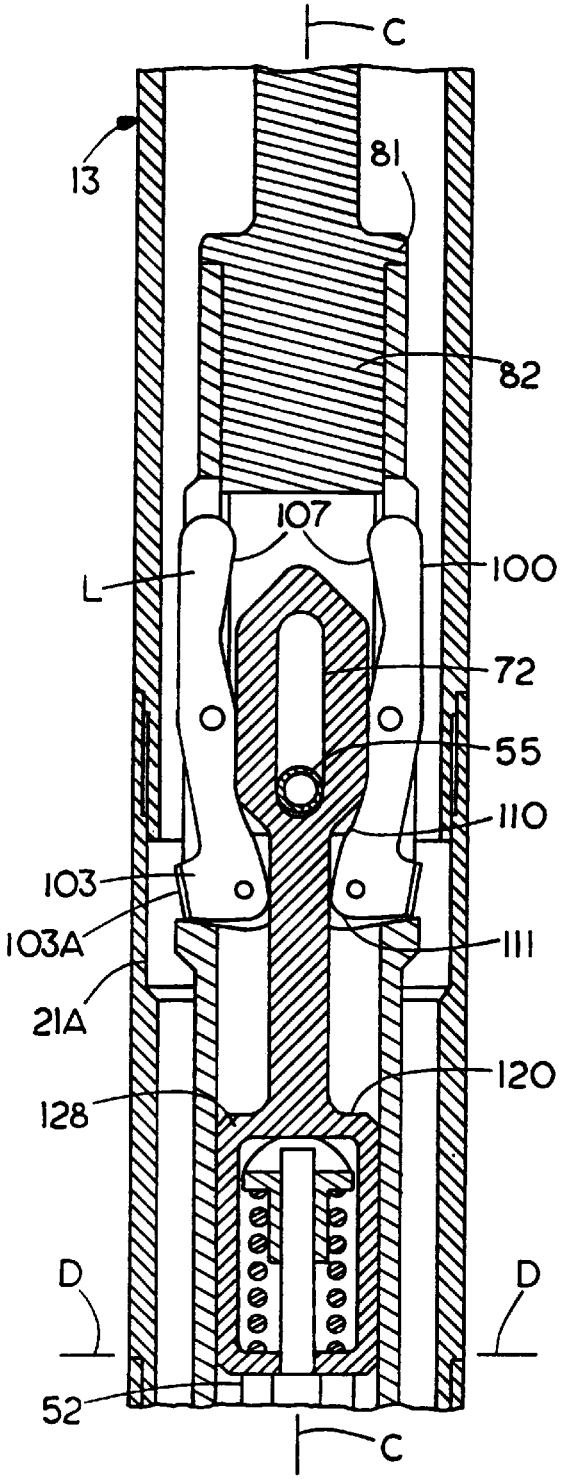
FIGS. 2A and 2B, one arranged above the other with the axial center lines aligned and lines D—D aligned, form a composite fragmentary longitudinal section through the core barrel apparatus as it initially contacts the drill string landing shoulder and just prior to the latches starting to move to their latched position.
Figure 2B:
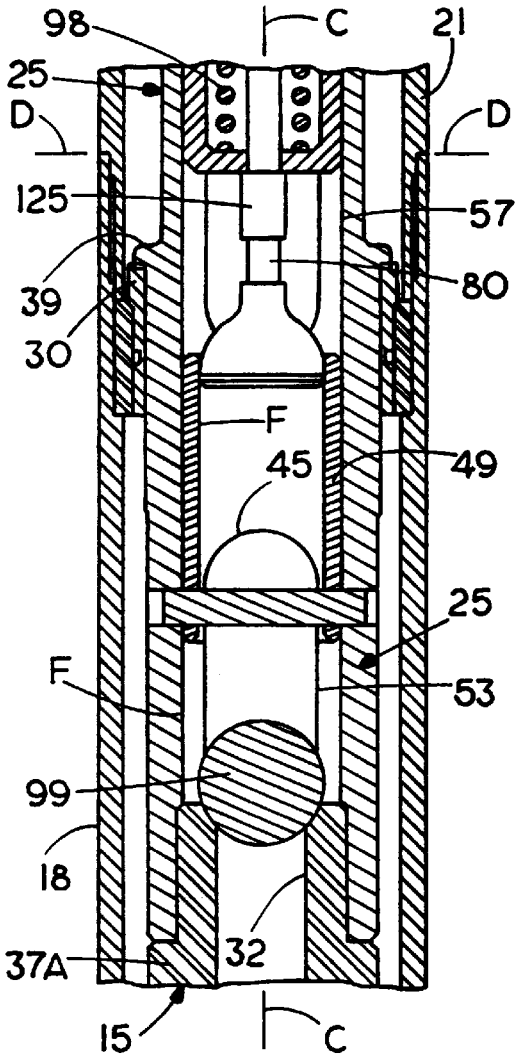

In the event one of the latch tabs, for example of latch 48, does not pivot to be in abuttable relationship to the inner terminal edge of coupling 20, its surface 110 would limit the movement of the retractor inwardly adjacent to the position shown in FIGS. 2A, 2B. At this time, the maximum diameter section of the valve member is located axially inwardly of the axial outer transverse edge of the bushing, but axially outwardly of the outermost edge portions of the ports 53 whereby the pressure at the drilling surface is higher than the normal drilling pressure. The pressure remaining higher than normal provides a signal at the drilling surface that the inner tube assembly has not properly latchingly engaged the latch seat.

With the latch retractor in its axial inner positions relative to the latch body, and pump-in pressure acting against the valve member 90, the fluid pressure results in an inward force being transmitted through the valve stem 80 to the stop 75 to compress the spring 78. Since the fluid pressure acting on the retention valve maximum transverse cross section is desirably equal to the valve spring rate (characteristics) times the amount of rod (valve) travel, the opening fluid pressure in an inward direction to allow increased inward fluid flow can be adjusted either by a change in the spring rate or by adjusting the amount of valve travel.

During the core taking step, the axial inward drilling force on the drill string is transmitted through the latch tabs to the axial inward adjacent surfaces of the latch body and/or the pivot members 51 and therethrough to the latch body. Usually, after a core jam which prevents the core receiving tube moving axially inwardly with the spindle member 37, or the core receiving tube has taken the desired axial length of core with the core abutting against the seal retainer, the seal retainer is forced outwardly relative to the spindle member to axially compress and radially expand the shut off member 76 in a conventional manner to provide a high pressure signal.

Upon discontinuance of pumping fluid under pressure into the drill string, the spring 98 resiliently moves the valve member outwardly whereby the valve member maximum diametric section may move axially outwardly of the bushing cutout outer end portions, if not already in such a position, but inwardly of the bushing outer terminal end, provided the head of fluid is not too great. After breaking the core in a conventional manner, a conventional wire line overshot assembly (not shown), is lowered or allowed to move axially inwardly to couple onto the overshot coupling device 59.

Now upon withdrawing the overshot assembly, first the coupling device moves the pin 55 to the outer end of the slot 72, if not already thereat, to start the retraction of the retractor. As the intersection of the cam surfaces 117, 118 move axially outwardly of the intersection of surfaces 110, 112, the latches are free to pivot toward their retracted positions and thence the intersection of the surfaces 115, 117 moves adjacent to latch surfaces 107. Still further retraction of the retractor moves the cam portion to move axially in engagement with the latch surfaces 107 to force the latches to pivot toward their latch retracted position relative to the latch body with the outer ends of the latches abutting against cam surfaces 117 to retain the latches in their retracted position. Prior to the intersections of cam surfaces 115, 117 abutting against latch surfaces 107, the maximum transverse diametric section of the valve member is moved out of the bushing and outwardly of the inner ends of ports 52 to permit the head of fluid that was retained outwardly of the valve member to flow axially inwardly of the valve member at a much greater rate to reduce the forced required to retract the inner tube assembly. After the cam portion has forced the latches to pivot to their latch retracted position and then as the retractor is further retracted, the pin 55 is moved to the outer ends of the latch body slots 58 to force the latch body to start moving axially outwardly.

While the latch body is being retracted, the valve ball is seated on the valve seat 93 to prevent fluid flowing through the core receiving tube to wash away the core. After the latch body landing ring is moved outwardly of the drill string landing ring, fluid can flow through the outer ports 52 and into the bushing and thence exit through the inner ports 53 to bypass the latch body landing ring as well as axially through the clearance space between the landing ring 30 and the drill string.

Thus, if the head assembly is utilized in an extremely dry hole condition, when the drilling is completed the fluid retention valve member 90 has a full drill string length column of hydrostatic head pressure acting upon the cross sectional area of the valve member 90. If not able to dump the hydrostatic head pressure when retracting the overshot coupling device, such could prevent the inner tube assembly being unlatched from the drill string upon retracting the overshot coupling device. However, with this invention, in retracting the overshot coupling device, the retention valve member is moved axially outwardly relative to the bushing 49 to release the hydrostatic pressure and the resulting inward force acting on the inner tube assembly to allow faster retrieval of the inner tube assembly.

Further, even though it is preferred that the latch body and bushing be two separate pieces, in place of providing a bushing 49, the latch body may be formed with an inner diametric portion axially between the opening of the ports to bore 57 that is the same as the inner diameter of the bushing to function the same manner as the bushing.

By using a different spacing of stops 75, 125 and/or a spring 98 of different characteristics and/or the valve member 90 and bushing 49 of different diameters, there may be provided only very little resistance to axial inward flow in the bypass channel F, or a greater resistance to axial inward flow during the drilling operation may be obtained to maintain a desired head of fluid in the drill string even though the bore hole 12 should extend into very loose earth formation or cavity. Thus, if desired, one or more of the members referred to in the preceding sentence may be replaced with another if it is desired to provide an open or less restricted fluid bypass channel at a different pump-in fluid pressure. In particular, by providing a spring 78 of characteristics to maintain a predetermined head of fluid (liquid) in the drill string, there will be fluid flow to maintain a stream of fluid to the bit end of the drill string even though fluid does not return to the drilling surface exterior of the drill string due to drilling in broken ground. At the same time, by providing the hollow spindle assembly, the inner tube assembly-will descend at a relatively rapid rate in the drill string.

Further, by providing the retractor and mounting thereof, if both of the latches do not move to their latch seated position, the valve assembly can not move to a position to allow the pump-in pressure to fall to a normal value and when the latches are in their seated position, the latches can not move out of their latch seated position until the overshot coupling moves the retractor axially outwardly.

With the present invention, there is always a better indication at the surface through monitoring standpipe pressure when the inner tube assembly is properly latched to the drill string. The spring 78 can be preloaded to obtain the desired artificial head by rotating the valve stem 80 relative to the valve mount without disassembling the head H. With reference thereto, the portion 80A of the valve stem below stop portion 125 may have lands (not shown) to facilitate rotating the valve stem while the outer stop 75 is of a shape to prevent it rotating relative to the valve mount Y while permitting it to move axially when the valve stem is rotated. When the standpipe gauge pressure rises to a value that is equal to hole pressure (static pressure) plus fluid retention preload, this gives an indication the inner tube assembly is latched to the drill sting. If the standpipe gauge reading never rises above the hole pressure, the inner tube assembly is not seated on the drill string landing shoulder. If the inner tube assembly landing shoulder is seated on the drill string landing shoulder and both latches do not pivot to their latch seated position, the valve restricts the inward fluid flow to an extent that the standpipe pressure will be and will remain higher than normal.

What is claimed is:

1. A drilling head assembly axially movable inwardly through a drill string to be adjacent to a bit end of the drill string and the drill string latch seat to seat on a drill string landing shoulder and retractable axially outwardly through the drill string, comprising an axially elongated latch body having an enlarged diametric portion seatable on the drill string landing shoulder, axial outer and inner portions joined to and respectively extending outwardly and inwardly of the diametric portion and a fluid bypass channel, including a bore, for bypassing fluid from axially outwardly of the enlarged diametric portion to axially inwardly of the enlarged diametric portion, a latch mounted to the latch body for movement between a latch seated position and a latch retracted position, latch retractor means mounted for limited axial movement relative to the latch body between an axial inner position for the latch moving to its latch seated position and an axial outer latch retracted position to retract the latch from its latch seated position, overshot coupling means connected to the retractor means for limited axial movement relative thereto between an axial inner position relative to the latch body and the retractor means and an axial outer position relative to the retractor means for applying a retracting force to at least one of the latch body and the retractor means to move the retractor means to its outer position and valving mechanism for selectively restricting fluid flow through the bypass channel and permitting at least nearly unrestricted axial inner fluid flow through the bypass channel when the retractor means is in its outer position, the valving mechanism including a valve member extendable within the bypass channel and axially movable between an axial inner fluid flow restricting position relative to the latch body to retain a desired pressure head in the drill string and an axial outer nearly unrestricted fluid flow open position and connecting means for connecting the valve member to the retractor means to move the valve member from its restricting position toward its axial outer open position as the retractor means is moved from its axial inner position toward its axial outer position, the retracting means having retaining means for maintaining the latch out of contact with the drill string and retraining the valve mechanism outwardly of the valve member fluid flow restricting position as the head assembly moves axially inwardly until the enlarged diametric portion seats on the drill string shoulder.

2. The drilling head assembly of claim 1 wherein the retractor means includes a valve mount and the connecting means includes adjustable preloading means mounted to the valve mount and mounting the valve member to obtain a desired head of fluid when the latch is in its latch seated position and the enlarged diametric portion is seated on the drill string landing shoulder.

3. The drilling head assembly of claim 1 wherein the retractor means includes an axial inner valve mechanism mount for mounting the valve mechanism, and an axial outer cam portion for abuttingly retaining the latch in a fully latch retracted position as the assembly moves inwardly in the drill string and abuttingly retaining the latch in its latch seated position when the retractor means is in its axial inner position and up until the coupling means moves the retractor means axially outwardly of its axial inner position.

4. The drilling head assembly of claim 1 wherein the latch body has an axial inner end portion, a spindle assembly is joined to the latch body inner end portion to extend inwardly thereof, the spindle assembly having an inner end portion, and a core receiving tube having an outer end portion is joined to the spindle assembly inner end portion, the spindle assembly including a spindle member having a bore for conducting fluid from the core receiving tube to the fluid bypass channel and an axial outer valve seat, a valve ball seatable against the valve seat to block axial inward flow from the bypass channel to the spindle bore and the valving mechanism includes a valve bushing in the fluid bypass channel axially outwardly of the valve ball and a valve seat to have the valve member move thereinto to cooperate therewith for restricting inward flow through the bypass channel, the valve member in the retractor means axial outer position being outwardly of the bushing.

5. The drilling head assembly of claim 1 wherein the connecting means includes an axially elongated valve stem axially movable relative to the valve mount and having an inner end portion mounting the valve member and an outer end portion and spring means acting between the valve mount and the valve stem outer end portion for resiliently urging the valve stem axially outwardly.

6. The drilling head assembly of claim 5 wherein the bypass channel includes an axial outer port opening to the bore and an axial inner port opening to the bore axial inwardly of the outer port and the valve mechanism includes a bushing having an axial inner end portion adjacent to the inner port with the valve member being adjacent thereto when the retractor means is in its axial inner position and an outer end portion inwardly of the opening of the outer port to the bore and of the valve member when the retractor means is in its axial outer position, the bushing being mounted in the bore to extend axially intermediate the ports.

7. The drilling head assembly of claim 6 wherein the retractor means has cam portions for camming the latch between its positions, the latch and cam portions having cooperating surfaces for blocking movement of the retractor means axially inwardly of an axial intermediate position such that the valve member extends into the bushing outer end portion to provide a greater restriction to axial inward fluid flow than in the retractor means inner position until the latch has moved from its retracted position to its latch seated position.

8. The drilling head apparatus of claim 1 wherein the latch is axially elongated and has an axial outer end portion, an intermediate portion pivotally mounted to the latch body and an axial inner portion and the retaining means has a cam surface portion abutting against the latch outer end portion when the retractor means is in its axial outer position and while the retractor means moves to its inner position, moves out of engagement with the latch outer end portion and into engagement with the latch inner end portion to pivot the latch to its latch seated position to retain the latch in its latch seated position until the retractor means is moved axially outwardly from the retractor means inner position.

9. The drilling head apparatus of claim 8 wherein the latch inner end portion has a surface part abuttable against the retaining means to block the retractor means moving to its axial inner position until the latch is free to and does move its latch seated position.

10. The drilling head apparatus of claim 9 wherein the retractor means includes an axial inner valve mount and the valve mechanism includes valve means that acts in cooperation with the connecting means to at least in part mount the valve member to the valve mount for providing selectively variable restriction to axial inward flow fluid when the valve member in its axial inner position and the retractor means abuts against the latch inner end portion surface part and the enlarged diametric portion seats on the drill string shoulder.

11. The drilling head assembly of claim 10 wherein the latch body has a radial outer first peripheral surface axially outwardly of the enlarged diametric portion and a radial outer second peripheral surface axially inwardly of the enlarged diametric portion, the bypass channel includes an outlet port opening through the outer second peripheral surface and to the bore and an inlet port opening through the outer second peripheral surface and to the bore and the valve mechanism includes an axially elongated bushing in the fluid bypass channel to extend axially intermediate the openings of the inlet and outlet ports to the bore, the valve mechanism in its flow restriction position extending into the bushing.

12. A drilling head assembly having an axially extending central axis and being movable axially inwardly through a drill string toward a bit end of the drill string to a position adjacent to the bit end of the drill string to latchingly engage a drill string latch seat and being retractable axially outwardly through the drill string in a direction away from the bit end of the drill string, said drill string having a central axis and a landing shoulder axially adjacent to the bit end, comprising a longitudinally elongated latch body having a central axis, an enlarged diametric portion, a first end portion extending axially outwardly of the diametric portion, a second end portion extending axially inwardly of the diametric portion, a fluid bypass channel that includes an axially extending bore, a first port opening radially and axially outwardly of the enlarged diametric portion and opening to the bore and a second port opening radially outwardly and axially inwardly of the enlarged diametric portion and opening to the bore axially inwardly of the first port opening to the bore, first and second latches mounted to the latch body for pivotal movement between a latch seated position and a latch retracted position, said latches having axial intermediate and axial outer and inner end portions, retractor means mounted to the latch body for limited axial movement relative to the latch body between an inner position and an axial outer position to retract the latch, said retractor means having transversely opposite surface portions for abutting against the latch outer end portions to retain the latches in their retracted position until the retractor means moves axially inwardly of its axial outer position, and when the retractor means is in its axial inner position and the latches are in their latch seated position, abuts against the latch inner end portions to retain the latches in their latch seated position until the retractor means is retracted, an overshot coupling device for retracting at least one of the latch body and the retractor means, first connecting means for connecting the coupling device to the retractor means and valving mechanism extending within the bore for controlling fluid flow through the bypass channel, the valving mechanism including a valve member having a maximum transverse outer diameter section axially movable in the bore and valve mounting means for mounting the valve member to the retractor means for movement therewith in the bypass channel between a bypass open first position when the retractor means is in its axial outer position and an axial inner second position for providing a desired restriction of axial inward flow through the bypass channel.

13. The drilling head assembly of claim 12 wherein the latches and retractor means have cooperating means for limiting inward movement of the retractor means to a third position intermediate the retractor means axial outer and inner positions such that the valve member is in an axial inner third position to provide substantially greater resistance to axial inward fluid flow than in the second position until both latches move to their latch seated position.

14. The drilling head assembly of claim 12 wherein the valve mounting means includes adjustable means mounting the valve member to the retractor means for adjusting the axial spacing of the valve member from the retractor means to selectively vary the resistance to inward fluid flow through the bypass channel when the retractor means is in its axial inner position.

15. The drilling head assembly of claim 14 wherein the adjustable means includes a valve stem mounting the valve member to the retractor means for limited axial movement relative thereto, resilient means acting against the valve stem and the retractor means to urge the valve stem axially outwardly and a stop accessible through the inner port when the retractor means is in its axial inner position to adjustably vary the compression of the resilient means for varying the resistance to axial inward flow through the bypass channel when the fluid is flowing inwardly through the bypass channel and the retractor means is in its axial inner position.

16. The drilling head assembly of claim 12 wherein the latches are pivotally mounted to pivot about transversely spaced, parallel pivot axes and the retractor means has an axial inner valve mount for mounting the valve mounting means, an axially elongated retractor stem joined to the valve mount to extend outwardly thereof and a cam portion that in a plane of the central axis and perpendicular to the latch pivot axes has an axial intermediate and axial outer cam portions having diametrically opposite surfaces that in an axial inward direction have surface portions that initially diverge, then extend substantially parallel to one another and to the central axis and thence converge to intersect the retractor stem, the retractor stem in said plane having parallel surfaces portions that intersect with the converging surface portions of the cam portion and are parallel to the central axis.

17. The drilling head apparatus of claim 16 wherein with the retractor means in its axial outer position, the latches in their latch retracted position in the above mentioned plane, have transversely adjacent surface portions that in an axial inward direction are arcuately transversely curved, then diverge, thence converge, next are nearly parallel to one another and the cam portion parallel surface portions, thence converge, and thereafter converge at an even smaller angle, and the latch inner end portion having tabs extending transversely more remotely from one another than the latch intermediate and outer end portions.

18. The drilling head apparatus of claim 17 wherein the valve mechanism includes a bushing mounted in the bore to extend axially intermediate the opening of the ports to the bore, the valve member has a maximum transverse diameter section that is only a few thousandths of an inch smaller than the minimum inner diameter of the bushing, the retractor means mounts the valve member to extend within the bushing when the retractor means is in its axial inner position and each of the retractor means and the latch body has an axially elongated slot and the connecting means comprises a pin fixed to the overshot coupling device and extended within the slots to limit the axial movement of the overshot coupling device relative to the latch body.

19. Drilling apparatus having an axially extending central axis and being movable axially inwardly through a drill string toward a bit end of the drill string to a position adjacent to the bit end of the drill string to latchingly engage a drill string latch seat and being retractable axially outwardly through the drill string in a direction away from the bit end of the drill string, said drill string having a central axis and a landing shoulder axially adjacent the bit end, comprising a longitudinally elongated latch body having a central axis, an axial intermediate enlarged diametric portion, an axial outer end portion and an axial inner end portion, an axially elongated latch having an outer end portion, an intermediate portion and an inner end portion, a transverse pivot member mounting the latch to the latch body for movement between a latch seated position for releasably retaining the latch body in the drill string adjacent to the bit end and a latch release position permitting the latch body being retracted through the drill string, axially extending latch retractor means for retracting the latch from its latch seated position, said latch retractor means being mounted to the latch body for movement therewith and limited axial movement relative thereto between an axial outer latch retracted position and an axial inner latch seated position, an overshot coupling device for retracting the retractor means, connecting means for mounting the overshot coupling device to the retractor means, a drilling tool having an axial outer end, the latch body enlarged diametric portion having a shoulder seatable on the drill string landing shoulder and, when seated on the drill string landing shoulder, substantially restricting fluid flow therebetween and a fluid bypass channel having a first port opening to the drill string axially outwardly of the latch body shoulder, a second port opening to the drill string axially inwardly of the latch body shoulder and a bore fluidly connecting the first port to the second port, and valving mechanism extending within the bore for controlling fluid flow through the bypass channel, said valving mechanism including a valve member movable in the bore for axial movement between an axial inner position for substantially restricting axial inward fluid flow through the bypass channel to maintain a desired head of fluid in the drill string when the latch is in its latch seated position, an axial intermediate position to provide a higher pressure signal than when in the axial inner position and an axial outer position providing a fluid bypass open position and means connecting the valve member to the retractor means for moving the valve member toward its open position prior to retracting the latch assembly from its latch seated position, the retractor means having a first surface portion abuttable against the latch outer end portion in axial spaced relationship to the latch inner end portion to retain the latch out of contact with the drill string as the latch body moves inwardly in the drill string, thence abuttable against the latch intermediate portion and out of contact with the latch outer end portion to block the movement of the retractor means inwardly to a position that the valve member is in its axial intermediate position while the enlarged diametric portion seats on the drill string landing shoulder and the latch is out of its latch seated position and thereafter abuttable against the latch inner end portion to retain the latch in its latch seated position after the latch moves to its latch seated position and the retractor means moves to its axial inner position.

20. The drill head assembly of claim 19 wherein therein there is provide a second latch of the same size and shape as the first latch and oppositely faced relative to the first latch, said second latch having an intermediate portion pivotally mounted to the latch body in diametrically spaced relationship to the first latch, the latch body has an axial outer and axial inner terminal ends with the bore opening therethrough, and the retractor means is mounted for movement within the bore and in its axial outer position extends transversely between the latches.

* * * * *